US010761455B2

(12) United States Patent
Yoshioka et al.

(10) Patent No.: US 10,761,455 B2
(45) Date of Patent: Sep. 1, 2020

(54) REPLENISHMENT SYSTEM, DEVELOPING DEVICE, AND IMAGE FORMING APPARATUS

(71) Applicant: FUJI XEROX CO., LTD., Tokyo (JP)

(72) Inventors: Sakae Yoshioka, Kanagawa (JP); Shota Makita, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/273,250

(22) Filed: Feb. 12, 2019

(65) Prior Publication Data

US 2020/0096903 A1 Mar. 26, 2020

(30) Foreign Application Priority Data

Sep. 20, 2018 (JP) ..... 2018-176281

(51) Int. Cl.
*G03G 15/08* (2006.01)
*G03G 15/09* (2006.01)

(52) U.S. Cl.
CPC ..... *G03G 15/0867* (2013.01); *G03G 15/0818* (2013.01); *G03G 15/0891* (2013.01); *G03G 15/0921* (2013.01)

(58) Field of Classification Search
CPC ..... G03G 15/0822; G03G 15/0865; G03G 15/0867; G03G 15/0868; G03G 15/0877; G03G 15/0887; G03G 15/0889; G03G 15/0891
See application file for complete search history.

(56) References Cited

U.S. PATENT DOCUMENTS

2005/0196184 A1* 9/2005 Koyama ..... G03G 15/0868 399/27
2012/0033997 A1* 2/2012 Fujita ..... G03G 15/0877 399/258

FOREIGN PATENT DOCUMENTS

JP 2001-249537 A 9/2001
JP 2007-304202 A 11/2007

* cited by examiner

*Primary Examiner* — Thomas S Giampaolo, II
(74) *Attorney, Agent, or Firm* — Sughrue Mion, PLLC

(57) ABSTRACT

A replenishment system includes a rotator, a path, and an accumulator. The rotator is disposed above a transport path along which a developer is transported and below a replenishment path for toner. The rotator rotates about an axis extending in a transport direction of the transport path while holding the developer. The path is provided downstream of the replenishment path in a rotation direction of the rotator, along a part of an outer circumference of the rotator. The path allows the toner from the replenishment path to move therealong in the rotation direction to the transport path. The accumulator is provided in an area including the path and extending from the path outward in a radial direction of the rotator. The accumulator accumulates the developer shifted upward from the transport path.

10 Claims, 10 Drawing Sheets

REPLENISHMENT SYSTEM, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2018-176281 filed Sep. 20, 2018.

BACKGROUND

(i) Technical Field

The present disclosure relates to a replenishment system, a developing device, and an image forming apparatus.

(ii) Related Art

Japanese Unexamined Patent Application Publication No. 2001-249537 describes a developing device including an agitator used to feed toner from a toner hopper to a developer storage case, and an arch-shaped or triangular pyramid-shaped predoctor blade at a toner replenish port.

While the amount of a developer accumulated in a path along which toner to be fed to a developer transport path moves is insufficient, a structure that stops toner feeding in response to accumulation of the developer may continue feeding toner sluggishly to the transport path without stopping toner feeding.

SUMMARY

Aspects of non-limiting embodiments of the present disclosure relate to a structure with an improved performance in stopping feeding of toner from a replenishment path to a transport path compared to a structure that accumulates a developer in only a path.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a replenishment system that includes a rotator, a path, and an accumulator. The rotator is disposed above a transport path along which a developer is transported and below a toner replenishment path. The rotator rotates about an axis extending in a transport direction of the transport path while holding the developer. The path is provided downstream of the replenishment path in a rotation direction of the rotator, along a part of an outer circumference of the rotator. The path allows toner from the replenishment path to move therealong in the rotation direction to the transport path. The accumulator is provided in an area including the path and extending from the path outward in a radial direction of the rotator. The accumulator accumulates the developer shifted upward from the transport path.

BRIEF DESCRIPTION OF THE DRAWINGS

Exemplary embodiments of the present disclosure will be described in detail based on the following figures, wherein.

DETAILED DESCRIPTION

Figure 1:
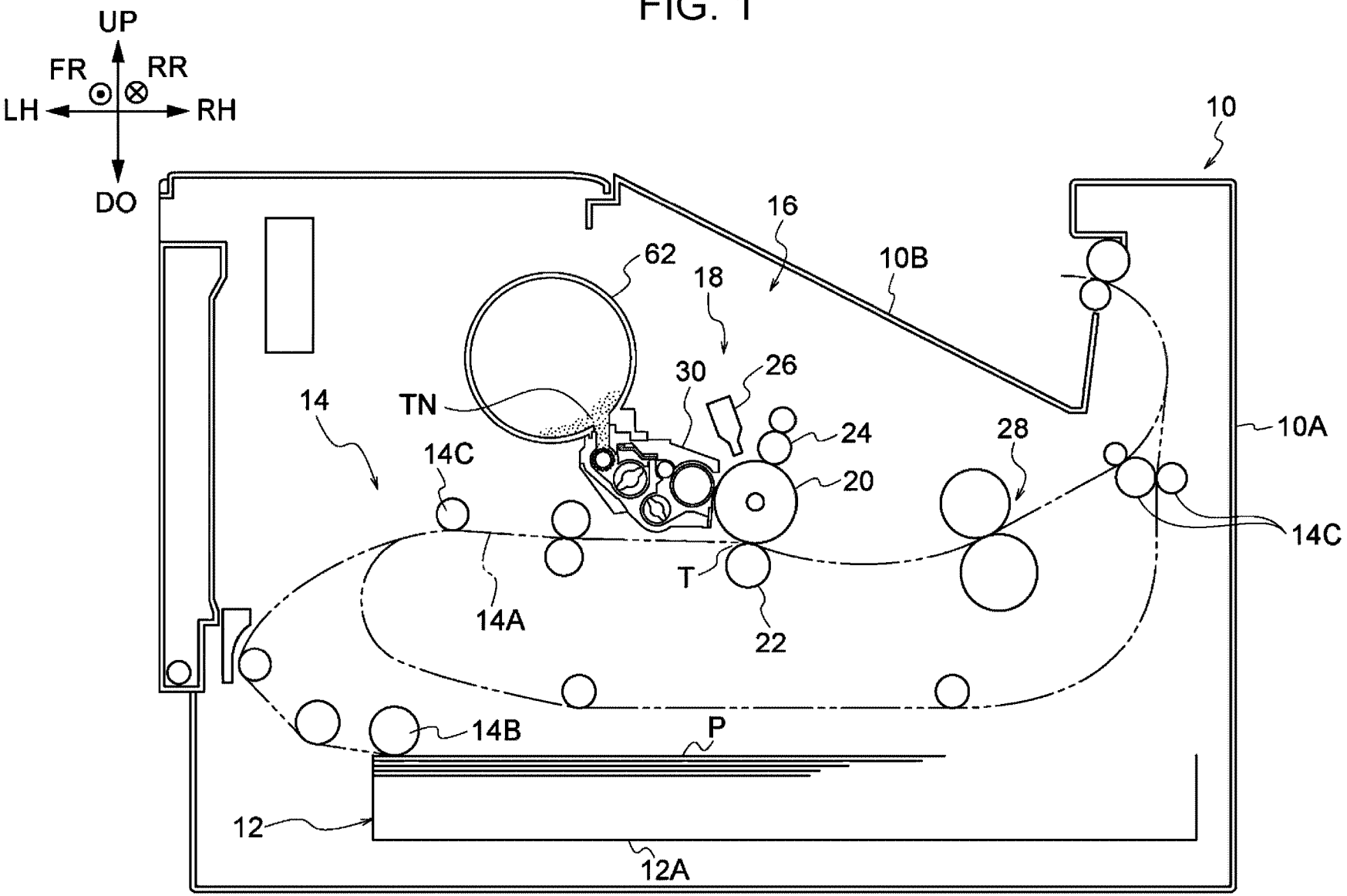
FIG. 1 is a schematic diagram of the structure of an image forming apparatus according to an exemplary embodiment.

Examples of exemplary embodiments according to the disclosure will now be described with reference to the drawings.

In the drawings, an arrow UP denotes the upper side of the apparatus (vertically upward), and an arrow DO denotes the lower side of the apparatus (vertically downward). In the drawings, an arrow LH denotes the left side of the apparatus, and an arrow RH denotes the right side of the apparatus. In the drawings, an arrow FR denotes the front of the apparatus, and an arrow RR denotes the rear of the apparatus. These directions are defined for convenience of illustration and do not limit the structure of the apparatus.

The upward and downward directions of the apparatus may be referred to as a vertical direction of the apparatus. The leftward and rightward directions of the apparatus may be referred to as a lateral direction of the apparatus. The lateral direction of the apparatus also serves as a width direction (horizontal direction) of the apparatus. The frontward and rearward directions of the apparatus may also be referred to as a front-rear direction of the apparatus. The front-rear direction of the apparatus also serves as a depth direction (horizontal direction) of the apparatus. The directions of the apparatus may be referred to without describing "of the apparatus". Specifically, for example, "the upper side of the apparatus" may be simply referred to as "the upper side".

In the drawings, the sign of an encircled cross denotes an arrow directing from the near side to the far side of the drawing. In the drawings, the sign of an encircled dot denotes an arrow directing from the far side to the near side of the drawing.

Image Forming Apparatus 10

An image forming apparatus 10 according to an exemplary embodiment will be described, first. FIG. 1 is a schematic diagram of a structure of the image forming apparatus 10.

As illustrated in FIG. 1, the image forming apparatus 10 includes a sheet containing portion 12, which contains sheets P, a transporting portion 14, which transports the sheets P, and an image forming portion 16, which forms images on the sheets P.

Sheet Containing Portion 12

The sheet containing portion 12 includes a containing member 12A, which is drawable frontward from a housing 10A of the image forming apparatus 10. The containing member 12A accommodates a stack of the sheets P. A pick-up roller 14B is disposed at the sheet containing portion 12. The pick-up roller 14B picks up the sheets P stacked in the containing member 12A and feeds the sheets P to a transport path 14A constituting the transporting portion 14. The sheets P are an example of a recording medium.

Transporting Portion 14

The transporting portion 14 includes, along the transport path 14A, a pick-up roller 14B, which picks up the sheets P from the containing member 12A, and multiple transport rollers 14C, which transport the sheets P to a sheet discharging portion 10B via the image forming portion 16.

Image Forming Portion 16

The image forming portion 16 includes an image forming unit 18, which forms black toner images. The image forming unit 18 includes a photoconductor drum 20, which is an example of a latent image carrier that holds latent images, an exposure device 26, a charging roller 24, which serves as a charging device, and a developing device 30.

In the image forming unit 18, the charging roller 24 charges the photoconductor drum 20 with electricity. The exposure device 26 exposes the photoconductor drum 20 charged by the charging roller 24 with light to form an electrostatic latent image (an example of a latent image). The developing device 30 develops the electrostatic latent image formed on the photoconductor drum 20 by the exposure device 26 into a toner image (an example of an image). The specific structure of the developing device 30 will be described, later.

The image forming portion 16 also includes a transfer roller 22, which is an example of a transfer portion that transfers the toner image developed by the developing device 30 to the sheet P, and a fixing device 28, which fixes the toner image to the sheet P with heat and pressure.

Developing Device 30

The developing device 30 will now be described with reference to FIG. 2 to FIG. 9.

Figure 2:
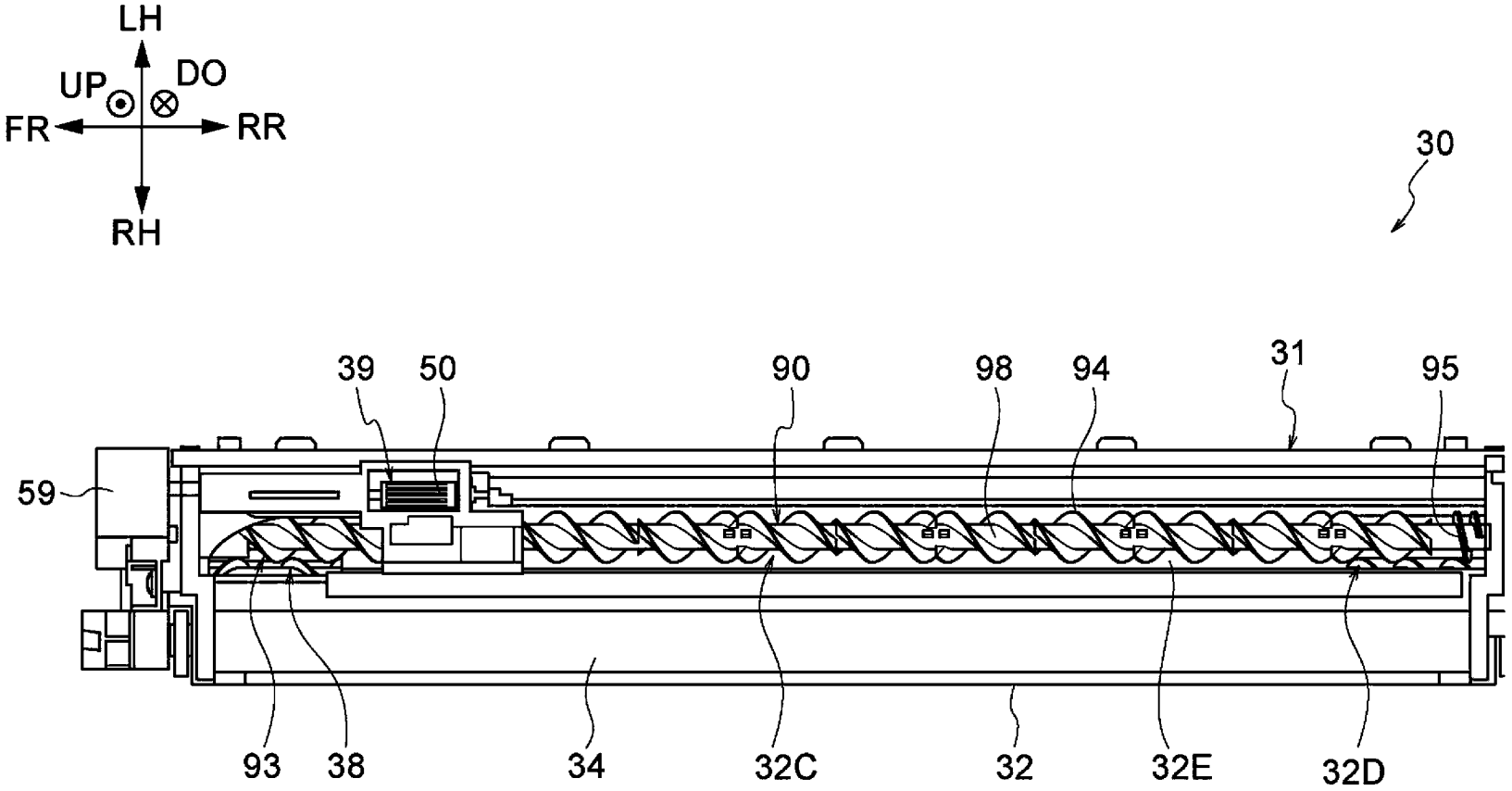
FIG. 2 is a plan view of a developing device according to the exemplary embodiment, from which an upper wall of a housing is omitted.
Figure 3:
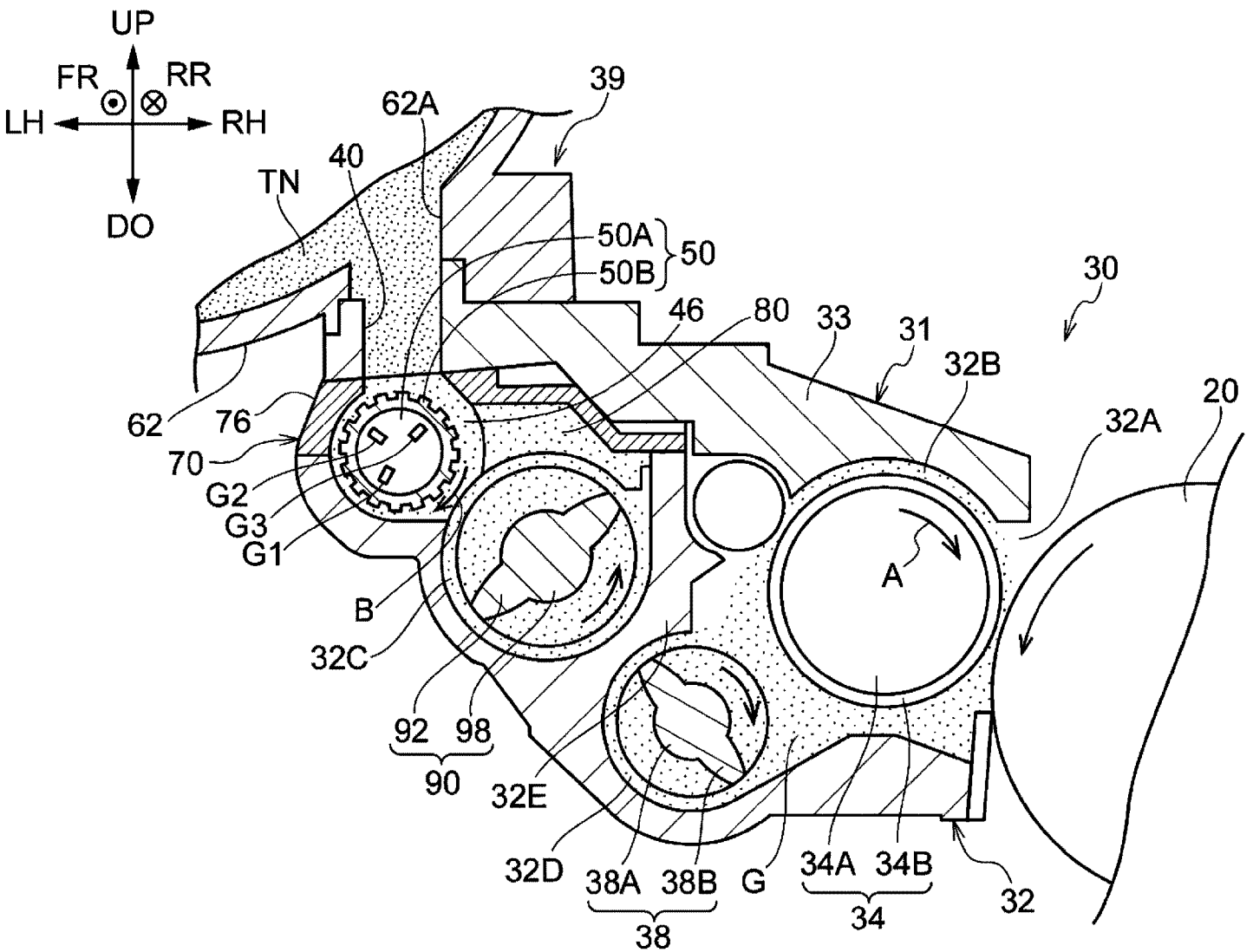
FIG. 3 is a cross-sectional view of the structure of the developing device according to the exemplary embodiment, viewed from the front.

As illustrated in FIG. 2 and FIG. 3, the developing device 30 includes a transport system 31, which transports a developer G containing toner TN, a development roller 34, which is an example of a supplier that supplies the developer G transported by the transport system 31 to the electrostatic latent image on the photoconductor drum 20, and a replenishment system 39, which replenishes the transport system 31 with the toner TN.

As illustrated in FIG. 3, the transport system 31 includes a housing 32, a lid 33, a feeding auger 38, which feeds the developer G to the development roller 34, a mixing auger 90, which mixes the developer G, and a projecting portion 80. The developer G according to the exemplary embodiment is a binary developer containing toner TN and a magnetic carrier as representative components. Here, the toner TN and the developer G are examples of powder.

The specific structures of the components of the transport system 31 (the housing 32, the feeding auger 38, the mixing auger 90, and the projecting portion 80), the development roller 34, and the replenishment system 39 are described below.

Housing 32

As illustrated in FIG. 3, the housing 32 accommodates the developer G. The housing 32 is constituted of an open-top box. At the open top of the housing 32, the lid 33 is disposed. The lid 33 covers the open top of the housing 32. While a supporter 70, described later, is disposed in the housing 32, the lid 33 is disposed at the top of the housing (refer to FIG. 4 and FIG. 5).

As illustrated in FIG. 3, the housing 32 is disposed adjacent to (on the left of) the photoconductor drum 20. At a portion of the housing 32 facing the photoconductor drum 20, an opening 32A, which leaves the inside of the housing 32 open, extends in the front-rear direction. On the side of the opening 32A opposite to the photoconductor drum 20, a delivery path 32B on which the development roller 34 is disposed extends in the front-rear direction.

Obliquely below the delivery path 32B, a feed path 32D on which the feeding auger 38 is disposed extends in the front-rear direction. On the side of the feed path 32D opposite to the delivery path 32B, a mixture path 32C on which the mixing auger 90 is disposed extends in the front-rear direction.

The wall surfaces defining the feed path 32D and the mixture path 32C have U-shaped cross sections. The mixture path 32C is a space defined by the wall surface having a U-shaped cross section and an arc-shaped lower surface 85 of the projecting portion 80, described later. The mixture path 32C is a cylindrical space, that is, a circular space when viewed in the front-rear direction. Between the feed path 32D and the mixture path 32C, a partitioning wall 32E, which separates the feed path 32D and the mixture path 32C from each other, is disposed.

As illustrated in FIG. 2, in the housing 32, the feeding auger 38 is disposed to extend from the front to the rear of the feed path 32D. FIG. 2 illustrates only the left and right ends of the feeding auger 38. The mixing auger 90 is disposed to extend from the front to the rear of the mixture path 32C.

The mixture path 32C and the feed path 32D have their front ends connected together and their rear ends connected together. The developer G circulates through the mixture path 32C and the feed path 32D. The partitioning wall 32E is disposed between, in the front-rear direction, a connection portion of the front ends of the mixture path 32C and the feed path 32D and a connection portion of the rear ends of the mixture path 32C and the feed path 32D.

Development Roller 34

As illustrated in FIG. 3, the development roller 34 is disposed on the delivery path 32B. The development roller 34 faces the photoconductor drum 20 through the opening 32A of the housing 32. Between the development roller 34 and the photoconductor drum 20, a gap (development gap) is formed to deliver the developer G from the development roller 34 to the photoconductor drum 20.

The development roller 34 includes a magnet roller 34A having a circular cross section, and a rotary sleeve 34B covering the magnet roller 34A and rotating around the magnet roller 34A.

The rotary sleeve 34B receives rotational force from a driving source, not illustrated, and rotates in the direction of arrow A (clockwise) in the drawing.

Feeding Auger 38

As illustrated in FIG. 3, the feeding auger 38 is disposed in the feed path 32D. Specifically, the feeding auger 38 is disposed in the housing 32. The feeding auger 38 functions as a transporting member that transports the developer G along the feed path 32D. Specifically, the feeding auger 38 has a function of transporting the developer G from the rear side to the front side. The feed path 32D thus has its rear side located upstream in the direction of transporting the developer G and its front side located downstream in the direction of transporting the developer G. Herein, "upstream in the direction of transporting the developer G" may be simply referred to as "upstream", and "downstream in the direction of transporting the developer G" may be simply referred to as "downstream".

The feeding auger 38 includes a feeding shaft 38A, extending in the front-rear direction, and a helical feeding blade 38B, disposed on the outer circumferential surface of the feeding shaft 38A.

Both ends of the feeding shaft 38A are rotatably supported by wall portions of the housing 32, so that the feeding shaft 38A is rotated by a driving source (not illustrated).

In this structure, the rotating feeding auger 38 feeds the developer G to the development roller 34 while transporting the developer G on the feed path 32D from the rear side (upstream side) to the front side (downstream side). The rotating feeding auger 38 delivers the developer G transported to the downstream side (front side) of the feed path 32D to the mixing auger 90 on the mixture path 32C on the upstream side (front side) of the mixture path 32C. Here, the mixture path 32C is an example of "a transport path".

Mixing Auger 90

As illustrated in FIG. 2 and FIG. 3, the mixing auger 90 is disposed on the mixture path 32C. Specifically, the mixing auger 90 is disposed in the housing 32. The mixing auger 90 has a function of transporting the developer G along the mixture path 32C. Specifically, the mixing auger 90 has a function of transporting the developer G from the front side to the rear side. Thus, the mixture path 32C has its front side disposed upstream in the direction of transporting the developer G, and its rear side disposed downstream in the direction of transporting the developer G.

Figure 6:
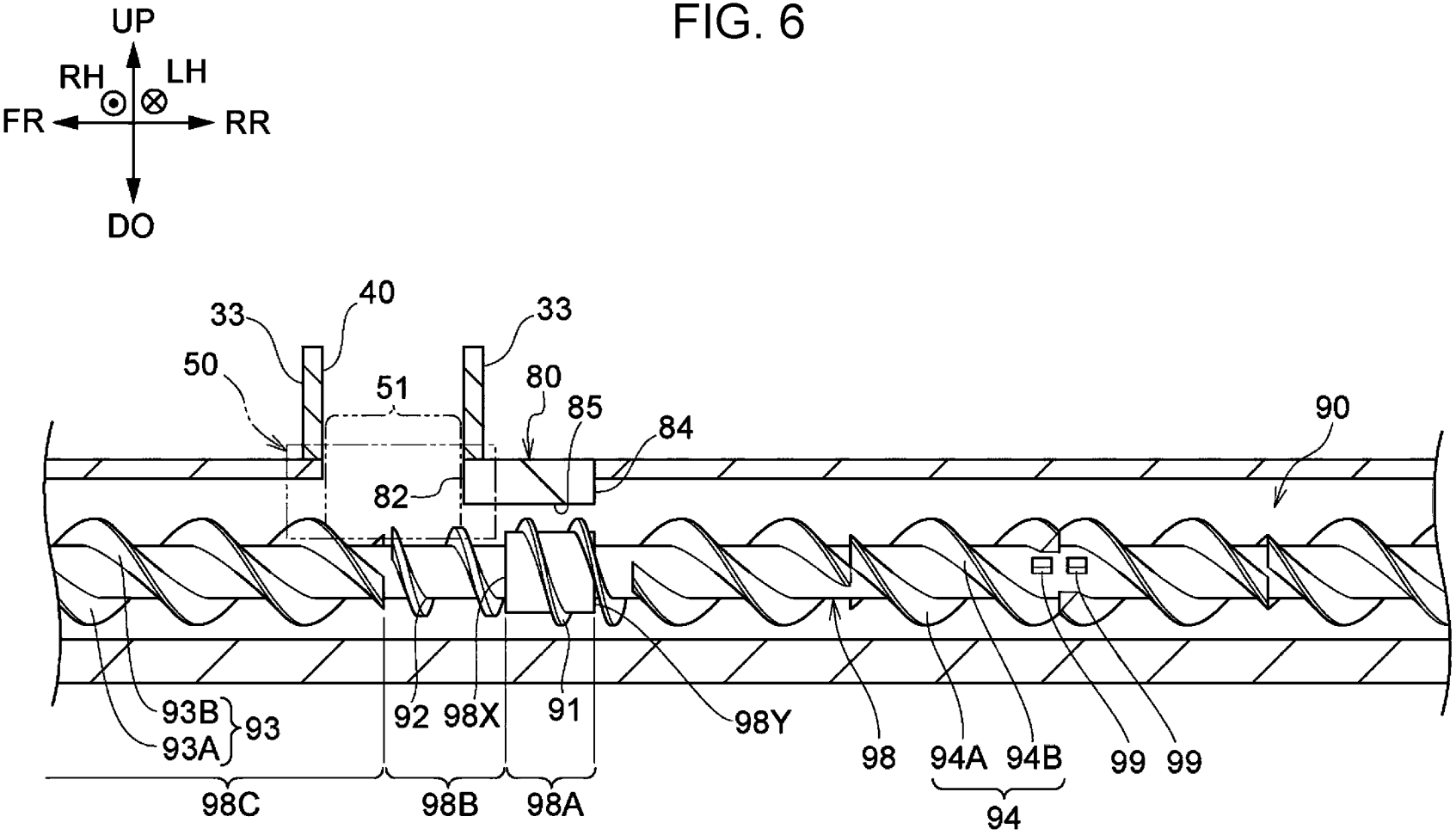
FIG. 6 is a cross-sectional view of the structure of the developing device according to the exemplary embodiment, viewed from a side.

Specifically, the mixing auger 90 includes, as illustrated in FIG. 6, a mixing shaft 98, a first blade 91, a second blade 92, a third blade 93, fourth blades 94, a pair of protrusions 99, and a fifth blade 95 (refer to FIG. 2).

In the mixing auger 90, the mixing shaft 98 rotates about the axis extending in the front-rear direction (transport direction) to transport the developer G from the feed path 32D and the toner fed to the mixture path 32C from the replenishment system 39 while mixing the developer G and the toner TN with the first blade 91, the second blade 92, the third blade 93, the fourth blades 94, the pair of protrusions 99, and the fifth blade 95.

The mixing auger 90 is an example of "a transporting member". The mixing shaft 98 is an example of "a shaft". The first blade 91, the second blade 92, the third blade 93, and the fourth blades 94 are examples of "a blade".

Specific structures of the components of the mixing auger 90 (the mixing shaft 98, the first blade 91, the second blade 92, the third blade 93, the fourth blades 94, the pair of protrusions 99, and the fifth blade 95) will now be described, below.

Mixing Shaft 98

As illustrated in FIG. 2, the mixing shaft 98 is disposed in the longitudinal direction of the mixture path 32C. Specifically, the mixing shaft 98 is disposed in the housing 32 to extend in the front-rear direction. The mixing shaft 98 has both ends in the axial direction rotatably supported by the wall portions of the housing 32. The mixing shaft 98 receives rotational force from the driving source (not illustrated), and rotates in one direction (counterclockwise in FIG. 3) about the axis extending in the front-rear direction (transport direction).

As illustrated in FIG. 2 and FIG. 6, the mixing shaft 98 has a large diameter portion 98A at a portion in the axial direction. The large diameter portion 98A projects outward in the radial direction of the mixing shaft 98. Thus, as illustrated in FIG. 6, at the upstream and downstream ends of the large diameter portion 98A in the transport direction, an upstream end surface 98X, facing upstream (frontward) in the transport direction, and a downstream end surface 98Y, facing downstream (rearward) in the transport direction, are formed. As illustrated in FIG. 6, the large diameter portion 98A is disposed to the rear of a rotary roller 50, described later, (disposed downstream in the transport direction) in the front-rear direction (in the transport direction of the mixture path 32C).

As illustrated in FIG. 6, the mixing shaft 98 has an immediately upstream portion 98B, disposed upstream of the large diameter portion 98A. The immediately upstream portion 98B is a part of the mixing shaft 98 disposed upstream of the large diameter portion 98A in the direction of transporting the developer G to be continuous with the large diameter portion 98A. The immediately upstream portion 98B is disposed within a limited area of the portion of the mixing shaft 98 upstream of the large diameter portion 98A in the transport direction.

The mixing shaft 98 also has an upstream portion 98C, disposed upstream of the immediately upstream portion 98B. The upstream portion 98C is a part of the mixing shaft 98 disposed upstream of the immediately upstream portion 98B in the direction of transporting the developer G to be continuous with the immediately upstream portion 98B.

First Blade 91

As illustrated in FIG. 6, the first blade 91 helically extends on the outer circumferential surface of the large diameter portion 98A. The first blade 91 transports the developer G to the rear (an example of one side in the axial direction) with rotation of the mixing shaft 98. Specifically, the first blade 91 is formed from a single blade.

The first blade 91 extends to the downstream outer circumferential surface of the large diameter portion 98A of the mixing shaft 98. In other words, the first blade 91 transports the developer G rearward beyond the large diameter portion 98A. The first blade 91 has its radial dimension increased in the downstream side of the large diameter portion 98A, to compensate for the reduction of the outer diameter of the mixing shaft 98 to be smaller than the large diameter portion 98A.

Second Blade 92

As illustrated in FIG. 6, the second blade 92 helically extends on the outer circumferential surface of the immediately upstream portion 98B of the mixing shaft 98. The second blade 92 transports the developer G to the rear (an example of one side of the axial direction) with the rotation of the mixing shaft 98.

The second blade 92 is continuous with the first blade 91. In other words, the front end (upstream end) of the first blade 91 is connected to the rear end (downstream end) of the second blade 92.

As illustrated in FIG. 6, specifically, the second blade 92 is formed from a single blade. The outer diameter of the second blade 92 is smaller than the outer diameter of the first blade 91. The helical pitch of the second blade 92 is the same as the helical pitch of the first blade 91, and smaller than the helical pitch of blades 93A and 93B of the third blade 93, described later, and the helical pitch of blades 94A and 94B of the fourth blades 94, described later. The helical pitch, here, is a length of the blade in the axial direction per 360 degrees (one turn) in the circumferential direction of the mixing shaft 98.

Third Blade 93

As illustrated in FIG. 6, the third blade 93 helically extends on the outer circumferential surface of the upstream portion 98C of the mixing shaft 98. The third blade 93 includes two blades 93A and 93B. The two blades 93A and 93B of the third blade 93 transport the developer G rearward with rotation of the mixing shaft 98.

Fourth Blade 94

As illustrated in FIG. 6, the fourth blades 94 are disposed downstream of the first blade 91, on the outer circumferential surface of the mixing shaft 98. The fourth blades 94 transport the developer G rearward with rotation of the mixing shaft 98.

Specifically, the fourth blades 94 each include two blades 94A and 94B. Multiple (for example, nine) fourth blades 94 are arranged in the axial direction of the mixing shaft 98. In the fourth blades 94, the multiple pairs of the two blades 94A and 94B transport the developer G rearward with rotation of the mixing shaft 98. The outer diameter of the blades 94A and 94B of the fourth blades 94 is the same as the outer diameter of the first blade 91, and the outer diameter of the blades 93A and 93B of the third blade 93.

Protrusions 99

As illustrated in FIG. 6, the pair of protrusions 99 are disposed on the outer circumferential surface of the mixing shaft 98 in the area including the fourth blades 94. The pair of protrusions 99 protrude outward in the radial direction of the mixing shaft 98. The pair of protrusions 99 protrude outward in the radial direction of the mixing shaft 98 also on the side opposite to the side illustrated in FIG. 6 and other drawings. The pair of protrusions 99 are disposed at a predetermined distance apart from each other in the axial direction of the mixing shaft 98.

Fifth Blade 95

As illustrated in FIG. 2, the fifth blade 95 helically extends on the outer circumferential surface at the downstream end (rear end) of the mixing shaft 98 in the transport direction. The fifth blade 95 is a single blade helically wound in the direction opposite to the direction in which the first blade 91, the second blade 92, the third blade 93, and the fourth blades 94 are wound. The fifth blade 95 transports the developer G frontward with rotation of the mixing shaft 98. The fifth blade 95 prevents the developer G from accumulating at the downstream end (rear end) of the mixture path 32C, and promotes shift of the developer G from the mixture path 32C to the feed path 32D.

Replenishment System 39

The replenishment system 39 is a system that replenishes the mixture path 32C with the toner TN. Specifically, as illustrated in FIG. 3, the replenishment system 39 includes a toner cartridge 62, a replenishment path 40, a rotary roller 50, and a supporter 70.

Toner Cartridge 62

As illustrated in FIG. 1, the toner cartridge 62 functions as a container that accommodates the toner TN. The toner cartridge 62 is cylindrical with both ends in the axial direction closed. As illustrated in FIG. 3, the toner cartridge 62 has a replenishment port 62A, through which the toner TN inside falls to replenish the mixture path 32C with the toner TN.

Replenishment Path 40

The replenishment path 40 is a path along which the toner is fed to the mixture path 32C from the toner cartridge 62. As illustrated in FIG. 3, the replenishment path 40 is formed in the lid 33. Specifically, the replenishment path 40 is open at a portion of the lid 33 obliquely above the mixture path 32C opposite to (on the left side of) the feed path 32D, and is connected to the replenishment port 62A of the toner cartridge 62 disposed above the lid 33.

As illustrated in FIG. 6, the replenishment path 40 is open at a portion upstream of (in front of) the large diameter portion 98A of the mixing shaft 98. Specifically, the replenishment path 40 is open at a portion upstream of (in front of) the projecting portion 80, and upstream of (in front of) the large diameter portion 98A of the mixing shaft 98.

In other words, the exemplary embodiment has a structure in which the housing 32 (specifically, the mixture path 32C) is replenished with the toner TN at a portion upstream of (in front of) the projecting portion 80, and upstream of (in front of) the large diameter portion 98A of the mixing shaft 98. The replenishment path 40 is an example of "a toner replenishment path".

Rotary Roller 50

Figure 4:
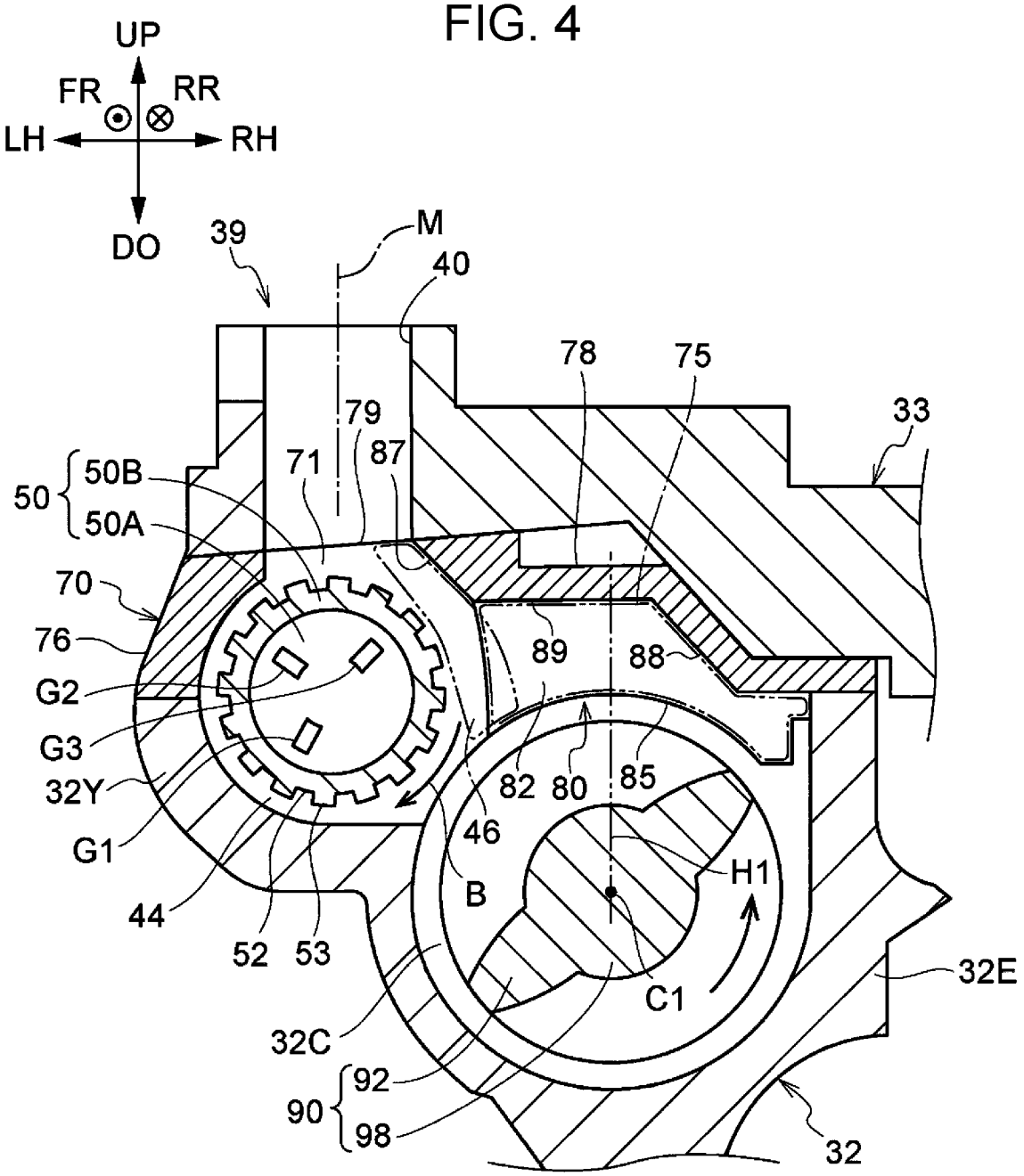
FIG. 4 is an enlarged cross-sectional view of a part of the developing device illustrated in FIG. 3 (cross-sectional view taken along line IV-IV in FIG. 7), viewed from the front.

As illustrated in FIG. 4, the rotary roller 50 is disposed below the replenishment path 40. When viewed in a plan, the opening of the replenishment path 40 at the downstream end is smaller than the outer dimension of the rotary roller 50. The rotary roller 50 is disposed at a portion that covers the opening.

The rotary roller 50 is disposed above the mixture path 32C. Specifically, the lower end of the rotary roller 50 is disposed below the upper end of the mixing auger 90 when viewed in the axial direction of the rotary roller 50 and the mixing auger 90. The right end portion of the rotary roller 50 is disposed to the right of the left end portion of the mixing auger 90. Specifically, the rotary roller 50 and the mixing auger 90 are disposed to vertically and laterally overlap each other.

As illustrated in FIG. 6, the rotary roller 50 is disposed above the immediately upstream portion 98B of the mixing shaft 98, along the mixing shaft 98. Specifically, the rotary roller 50 is disposed to extend above and across the immediately upstream portion 98B and the upstream portion 98C of the mixing shaft 98.

Figure 9:
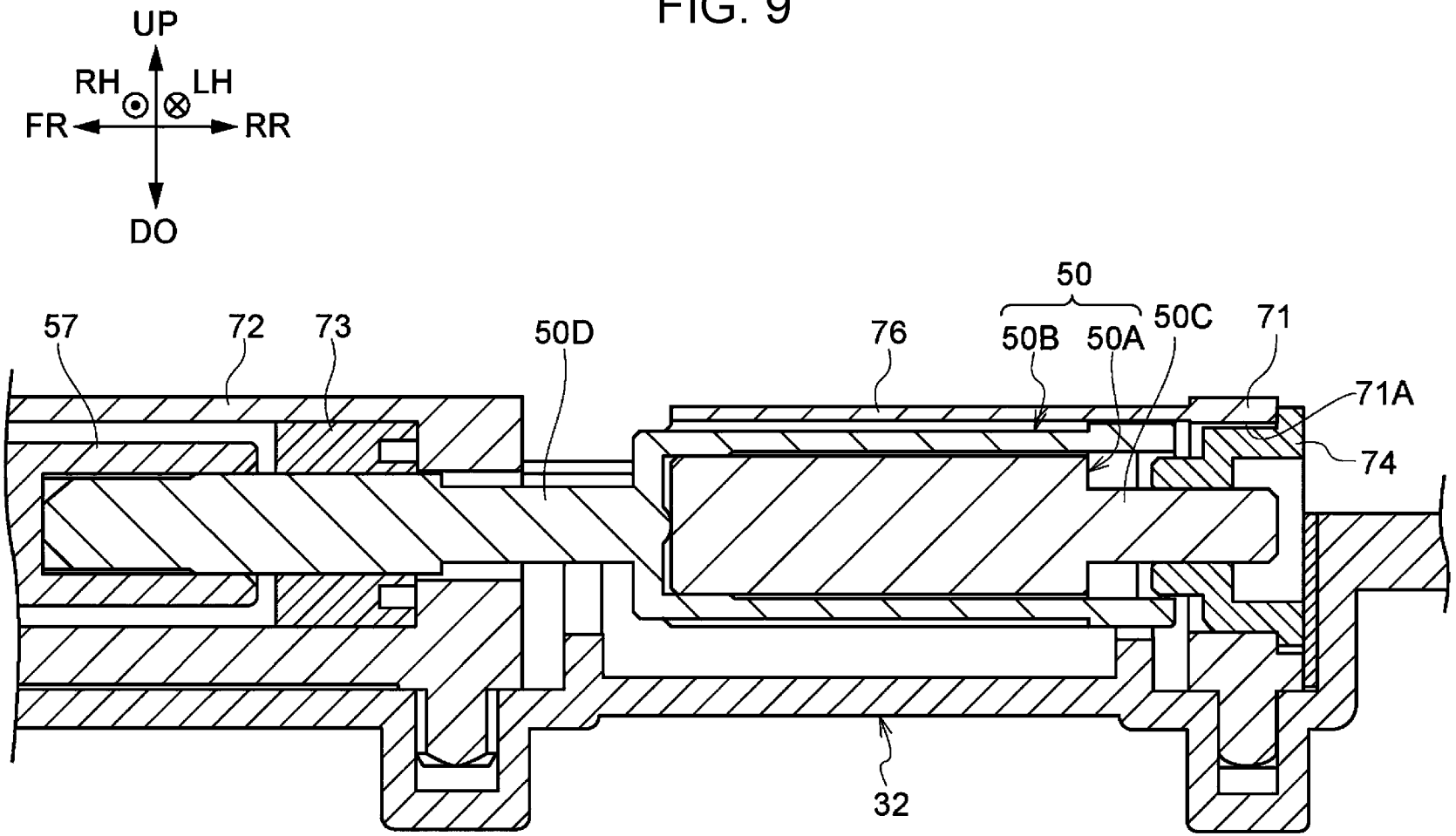
FIG. 9 is a cross-sectional view of the supporter according to the exemplary embodiment, viewed from a side (cross-sectional view taken along line IX-IX of FIG. 7)

As illustrated in FIG. 3 and FIG. 9, the rotary roller 50 includes a magnet roller 50A, which is a magnetic body, and a rotary sleeve 50B.

The magnet roller 50A is cylindrical. As illustrated in FIG. 9, the magnet roller 50A includes a shaft portion 50C, which protrudes from a first end in the axial direction (rear end) to a first side in the axial direction (to the rear side). The magnet roller 50A has a function of holding the developer G on the outer circumference of the rotary sleeve 50B with the magnetic force.

As illustrated in FIG. 4, the rotary sleeve 50B is a cylinder that covers the outer circumference of the magnet roller 50A. Specifically, the rotary sleeve 50B is a cylinder having a second end in the axial direction (front end) closed. As illustrated in FIG. 9, the rotary sleeve 50B includes a shaft portion 50D, which protrudes from a second end in the axial direction (front end) to a second side in the axial direction (to the front side).

The magnet roller 50A is fixed to the supporter 70 so as not to rotate. On the other hand, the rotary sleeve 50B is rotated by a driving source 59 (refer to FIG. 2) about an axis extending in the front-rear direction around the outer circumference of the magnet roller 50A in the direction of arrow B. Specifically, the rotary sleeve 50B rotates about the axis extending in the transport direction of the mixture path 32C.

As illustrated in FIG. 4, the magnet roller 50A has, inside, a first magnetic pole Gl, a second magnetic pole G2, and a third magnetic pole G3. In the exemplary embodiment, for example, the first magnetic pole G1 is a south pole, the second magnetic pole G2 is a north pole, and the third magnetic pole G3 is a south pole. The rotary roller 50 holds the developer G on the outer circumference of the rotary sleeve 50B using the magnetic field formed by the first magnetic pole Gl, the second magnetic pole G2, and the third magnetic pole G3.

Figure 8:
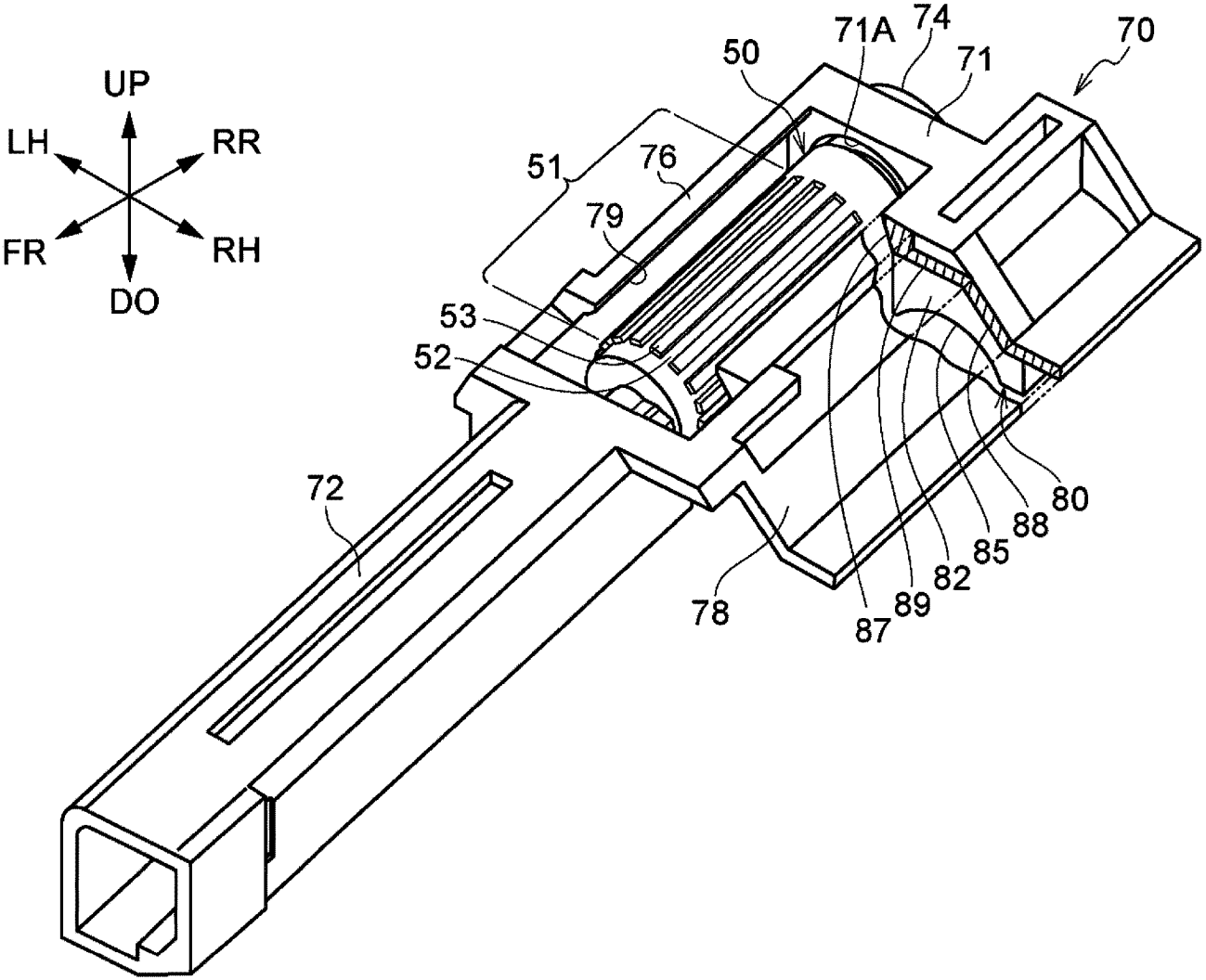
FIG. 8 is a perspective view of the structure of the supporter according to the exemplary embodiment.

The rotary roller 50 holds the developer G over a holding area 51 (refer to FIG. 8) of the rotary sleeve 50B at a center portion in the axial direction. As illustrated in FIG. 8, in the holding area 51 of the rotary sleeve 50B, recesses 52 and ridges 53 are formed on the outer circumferential surface. The recesses 52 and the ridges 53 are alternately arranged in the circumferential direction of the rotary roller 50. The recesses 52 and the ridges 53 extend in the axial direction of the rotary roller 50. As illustrated in FIG. 6, the dimension of the holding area 51 in the front-rear direction is equivalent to the dimension of the replenishment path 40 in the front-rear direction. Specifically, when viewed in the lateral direction, the rear end of the holding area 51 is flush with the rear end of the replenishment path 40, and the front end of the holding area 51 is flush with the front end of the replenishment path 40. The rotary roller 50 is an example of "a rotator".

Supporter 70

Figure 5:
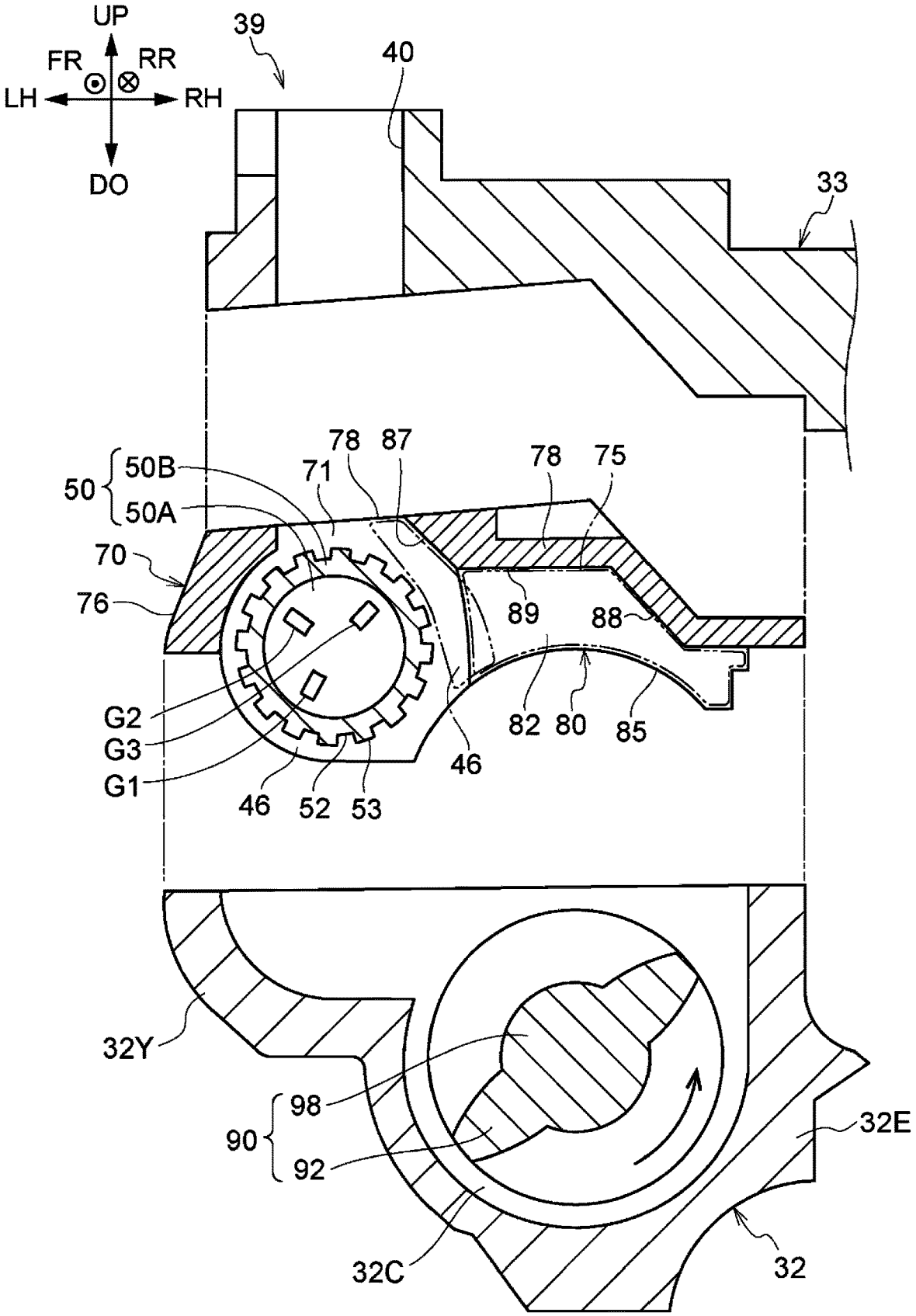
FIG. 5 is an exploded cross-sectional view of a housing, a supporter, and a lid, illustrated in FIG. 4, viewed from the front.

The supporter 70 illustrated in FIG. 3, FIG. 4, FIG. 5, and FIG. 7 has a function of supporting the rotary roller 50. As illustrated in FIG. 5, the supporter 70 is separate from the housing 32 having the mixture path 32C inside. Specifically, as illustrated in FIG. 8, the supporter 70 includes a first support portion 71, a second support portion 72, a coupling portion 76, a forming portion 78, and a projecting portion 80. The first support portion 71, the second support portion 72, the coupling portion 76, the forming portion 78, and the projecting portion 80 are integrated together, and the supporter 70 is formed from a single structure.

The first support portion 71 has a supporting function of supporting a first end portion (rear end portion) of the rotary roller 50 in the axial direction. Specifically, as illustrated in FIG. 9, the first support portion 71 has a function of supporting the magnet roller 50A of the rotary roller 50. The first support portion 71 is disposed at a first end side (rear side) of the rotary roller 50 in the axial direction. The first support portion 71 has a thickness in the front-rear direction, and is formed from a wall portion having a circular hole 71A. Into a circular hole 71A of the first support portion 71, a fastening member 74, which fastens the shaft portion 50C of the magnet roller 50A, is attached. Thus, the magnet roller 50A is supported by the supporter 70 while being left unrotatable (fixed in position) with respect to the supporter 70.

The second support portion 72 has a supporting function of rotatably supporting the second end portion (front end) of the rotary roller 50 in the axial direction.

Specifically, the second support portion 72 has a function of rotatably supporting the rotary sleeve 50B of the rotary roller 50.

As illustrated in FIG. 8, the second support portion 72 is disposed at the second end side (front side) of the rotary roller 50 in the axial direction. The second support portion 72 extends to the front side of the rotary roller 50, and is cylindrical with its axis extending in the front-rear direction. As illustrated in FIG. 9, a bearing 73, which rotatably supports the shaft portion 50D of the rotary sleeve 50B, is disposed inside the second support portion 72. The shaft portion 50D of the rotary sleeve 50B supported by the bearing 73 receives driving force from the driving source 59 (refer to FIG. 2) via a transmission portion 57, and, as illustrated in FIG. 4, the rotary sleeve 50B rotates around the magnet roller 50A in the direction of arrow B.

As illustrated in FIG. 8, the coupling portion 76 has a function of coupling the first support portion 71 and the second support portion 72, together. Specifically, the coupling portion 76 couples the left end portion of the first support portion 71 and the left end portion of the second support portion 72 together. The coupling portion 76 extends in the front-rear direction. The rear end of the coupling portion 76 is connected to the left end portion of the first support portion 71, and the front end of the coupling portion 76 is connected to the left end portion of the second support portion 72.

Figure 7:
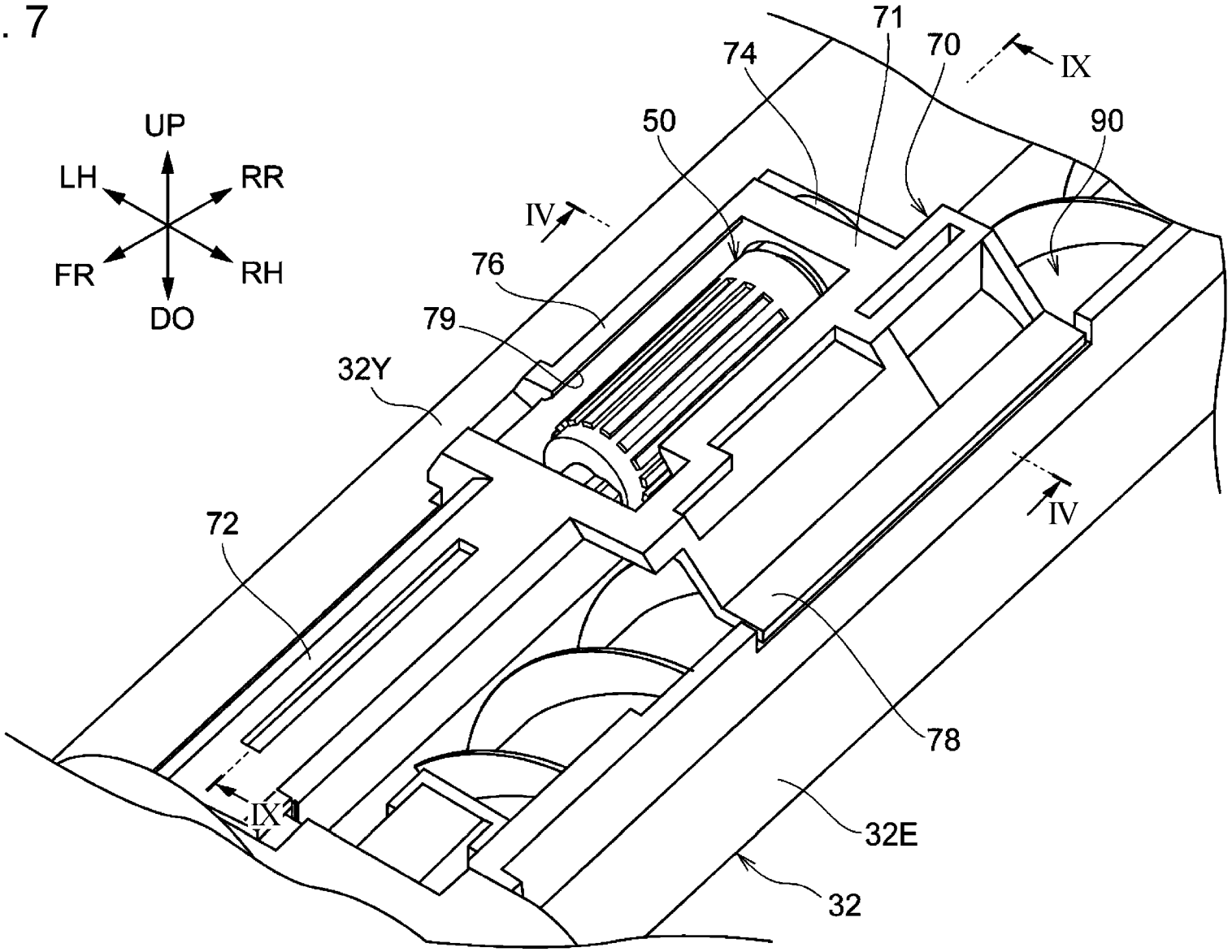
FIG. 7 is a perspective view of the structure of a supporter attached to the housing of the developing device according to the exemplary embodiment.

As illustrated in FIG. 4 and FIG. 7, the coupling portion 76 is supported on a left wall 32Y (side wall) of the housing 32. Between the coupling portion 76 and the left wall 32Y and the rotary roller 50, as illustrated in FIG. 4, a first path 44, which connects the mixture path 32C and the replenishment path 40, is disposed. Specifically, the first path 44 is provided upstream of the replenishment path 40 in the rotation direction B of the rotary roller 50, and along a part of the outer circumference of the rotary roller 50. The first path 44 allows the developer G and the toner TN to pass therealong.

As illustrated in FIG. 5 and FIG. 8, the forming portion 78 is a portion at which the projecting portion 80 is disposed. As illustrated in FIG. 8, the forming portion 78 couples the right end portion of the first support portion 71 and the right end portion of the second support portion 72, together. The forming portion 78 extends in the front-rear direction, and as illustrated in FIG. 4 and FIG. 7, and projects from the first support portion 71 and the second support portion 72 toward the mixing auger 90 (to the right side) of the rotary roller 50.

The forming portion 78, the first support portion 71, the second support portion 72, and the coupling portion 76 form the supporter 70 having a frame shape having a connection port 79, when viewed in a plan (refer to FIG. 7). As illustrated in FIG. 4, the connection port 79 is connected to a lower end portion of the replenishment path 40. The dimension of the connection port 79 in the front-rear direction is longer than the dimension of the replenishment path 40 in the front-rear direction.

The forming portion 78, which projects to the right of the rotary roller 50, is disposed above the mixing auger 90 (mixture path 32C). As illustrated in FIG. 4 and FIG. 7, the right end portion of the forming portion 78 is supported by an upper end portion of the partitioning wall 32E.

Between the forming portion 78 and the rotary roller 50, as illustrated in FIG. 4, a second path 46, which connects the mixture path 32C and the replenishment path 40 to each other, is provided. Specifically, the second path 46 is disposed downstream of the replenishment path 40 in the rotation direction B of the rotary roller 50, along a part of the outer circumference of the rotary roller 50. The second path 46 allows the developer G and the toner TN to move therealong. The toner from the replenishment path 40 moves along the second path 46 in the rotation direction B to the mixture path 32C. The second path 46 is an example of "a path".

The forming portion 78 forms a path surface 87 of the second path 46 along a part of the outer circumferential surface of the rotary roller 50 in the circumferential direction. The path surface 87 is a surface facing the outer circumferential surface of the rotary roller 50, and is shaped in an arc when viewed in the axial direction. Specifically, the path surface 87 has a shape of an arc of a circle having a center at the rotation center of the rotary roller 50.

As illustrated in FIG. 4 and FIG. 8, the projecting portion 80 projects to the mixture path 32C from the forming portion 78. Specifically, as illustrated in FIG. 4, the projecting portion 80 projects to the mixture path 32C from the upper side of the mixture path 32C.

Specifically, the projecting portion 80 projects downward from the forming portion 78 toward the large diameter portion 98A of the mixing shaft 98 of the mixing auger 90. In other words, the projecting portion 80 projects downward toward the large diameter portion 98A from above the large diameter portion 98A in the axial direction of the mixing shaft 98.

The lower surface 85 of the projecting portion 80 is formed in an arc, when viewed in the axial direction of the mixing shaft 98, extending along the outer circumferential surface of the large diameter portion 98A. The lower surface 85 forms the path surface of the mixture path 32C.

In other words, the projecting portion 80 has a function of reducing the path width of the large diameter portion 98A and the mixture path 32C around the large diameter portion 98A. More specifically, the projecting portion 80 has a function of reducing the volume (capacity) of the mixture path 32C around the large diameter portion 98A and its periphery.

As illustrated in FIG. 6, at the upstream and downstream ends of the projecting portion 80 in the transport direction, an upstream end surface 82, facing upstream (frontward) in the transport direction, and a downstream end surface 84, facing downstream (rearward) in the transport direction, are formed. FIG. 6 illustrates the projecting portion 80 in a cross section taken along dot-dash line H1 in FIG. 4. FIG. 6 illustrates the lid 33 and the replenishment path 40 in cross sections taken along dot-dash line M in FIG. 4.

The upstream end surface 82 of the projecting portion 80 serves as a stopper surface that stops the developer G transported along the mixture path 32C. The upstream end surface 82 may be also referred to as a stopper surface 82, below. The stopper surface 82 stops the developer G transported along the mixture path 32C to accumulate the developer G.

As illustrated in FIG. 4, an accumulation space 75 in which the developer G is accumulated by the stopper surface 82 is formed in the area including the second path 46 and extending from the second path 46 outward (to the right side) in the radial direction of the rotary roller 50. In the accumulation space 75, the developer G stopped by the stopper surface 82 and shifted upward from the mixture path 32C accumulates. The accumulation space 75 is an example of an accumulator.

In other words, the accumulation space 75 includes the second path 46, and the area in which the toner TN moving along the second path 46 does not pass. Specifically, the accumulation space 75 includes an area in which the toner TN does not pass when moving from the replenishment path 40 to the mixture path 32C. In other words, the stopper surface 82 may be regarded as including a portion that the toner TN moving along the second path 46 does not touch. Furthermore, the accumulation space 75 may be regarded as including an area other than the flow path from the replenishment path 40 to the mixture path 32C.

More specifically, the accumulation space 75 is a space above the mixture path 32C. As described above, the mixture path 32C is a space defined by the wall surface of the housing 32 having a U-shaped cross section, and the arc-shaped lower surface 85 of the projecting portion 80, and is a circular space when viewed in the front-rear direction.

As illustrated in FIG. 6, the stopper surface 82 is disposed upstream of the downstream end of the rotary roller 50 in the transport direction. Specifically, the stopper surface 82 is disposed downstream of the upstream end of the rotary roller 50 in the transport direction, and upstream of the downstream end of the rotary roller 50 in the transport direction. More specifically, the stopper surface 82 is disposed between the downstream end of the holding area 51 of the rotary roller 50 in the transport direction, and the downstream end of the rotary roller 50 in the transport direction. More specifically, the stopper surface 82 is flush with the downstream end of the holding area 51 of the rotary roller 50 in the transport direction. In other words, the stopper surface 82 is disposed at the same position, in the front-rear direction, as the downstream end of the holding area 51 of the rotary roller 50 in the transport direction.

The stopper surface 82 is flush with the downstream end of the replenishment path 40 in the transport direction. Specifically, the stopper surface 82 is disposed at the same position, in the front-rear direction, as the downstream end of the replenishment path 40 in the transport direction.

As illustrated in FIG. 4 and FIG. 8, the forming portion 78 has a restriction surface 89, disposed above the lower surface 85 of the projecting portion 80 to restrict upward shift of the developer G accumulated in the accumulation space 75. When viewed in the front-rear direction (when viewed in the axial direction of the rotary roller 50), the restriction surface 89 extends rightward (outward in the radial direction of the rotary roller 50) from the lower end of the path surface 87. The restriction surface 89 is a surface facing downward to the mixing auger 90. The restriction surface 89 is disposed below the upper end of the rotary roller 50. The restriction surface 89 may be also said as being disposed below the lower end (downstream end) of the replenishment path 40. Furthermore, the restriction surface 89 may be also said as being disposed below the upper end (upstream end) of the second path 46. The restriction surface 89 is disposed above the rotation center of the rotary roller 50. In other words, the restriction surface 89 is disposed at a portion that the toner TN moving along the second path 46 does not touch.

The forming portion 78 also includes an inclined surface 88, which extends obliquely downward to the right from the right end of the restriction surface 89 when viewed in the front-rear direction. The accumulation space 75 may be also said as a space including a space defined by the stopper surface 82, the restriction surface 89, and the inclined surface 88.

The accumulation space 75 includes an area on a side of a vertically upper position of the rotation center of the mixing auger 90, the side being opposite to the side closer to the second path 46 (on the right side of the vertically upper position). Dot-dash line H1 illustrated in FIG. 4 is an extension line extended vertically upward from the rotation center Cl of the mixing auger 90. The accumulation space 75 may be an area extending from the second path 46 to the side of the extension line H1 closer to the second path 46 (on the left side of the extension line H1).

The accumulation space 75 extends upstream from the second path 46 in the rotation direction of the mixing shaft 98. Specifically, the accumulation space 75 extends around the mixing shaft 98 counterclockwise in FIG. 4. In other words, the accumulation space 75 extends rightward from the second path 46. In other words, in the present exemplary embodiment, the mixing auger 90 may be regarded as rotating from the right end portion (the end farther from the second path 46) of the accumulation space 75 toward the second path 46 (to the left side). The supporter 70 itself may be regarded as an example of the replenishment system.

Operation of Rotary Roller 50

In the rotary roller 50, as illustrated in FIG. 4, the rotary sleeve 50B regularly rotates in the direction of arrow B. In the rotary roller 50, the magnetic field formed by the first magnetic pole Gl, the second magnetic pole G2, and the third magnetic pole G3 holds, at the position of the first magnetic pole G1 on the outer circumference of the rotary sleeve 50B, the developer G accumulated upstream of the large diameter portion 98A of the mixing shaft 98 (the immediately upstream portion 98B and the upstream portion 98C). Then, with rotation of the rotary sleeve 50B, the developer G is transported to the third magnetic pole G3, and released at the position of the third magnetic pole G3.

Development Operation of Developing Device

The operation of the developing device 30 will now be described.

In the housing 32 of the developing device 30 illustrated in FIG. 2, the rotating feeding auger 38 and the rotating mixing auger 90 circulate the developer G between the feed path 32D and the mixture path 32C while mixing the developer G.

When the developer G is mixed, the toner TN and the magnetic carrier in the developer G are rubbed against each other, and the toner TN is charged by friction with a predetermined polarity.

The feeding auger 38 illustrated in FIG. 3 feeds the developer G to the development roller 34. The developer G fed to the development roller 34 is held on the surface of the development roller 34 in the form of a magnetic brush (not illustrated) with the magnetic force of the magnet roller 34A.

The rotating rotary sleeve 34B then transports the developer G to a position facing the photoconductor drum 20.

The toner TN contained in the developer G transported to a development gap of the photoconductor drum 20 adheres to an electrostatic latent image formed on the photoconductor drum 20, and the electrostatic latent image is thus developed into a toner image.

Thus, the developing device 30 feeds to the photoconductor drum 20 the developer G to form an image on the sheet P. The developing device 30 is replenished with the toner TN in the following manner.

Operation of Replenishment with Toner TN

As illustrated in FIG. 4, in the developing device 30, the rotary sleeve 50B of the rotary roller 50 regularly rotates in the direction of arrow B. The magnetic field formed by the first magnetic pole G1, the second magnetic pole G2, and the third magnetic pole G3 holds, at the position of the first magnetic pole G1 on the outer circumference of the rotary sleeve 50B, the developer G accumulated upstream of the large diameter portion 98A of the mixing shaft 98 (the immediately upstream portion 98B and the upstream portion 98C). With rotation of the rotary sleeve 50B, the developer G is transported to the third magnetic pole G3, and released at the position of the third magnetic pole G3.

Specifically, the rotary roller 50 holds the developer G accumulated upstream of the large diameter portion 98A of the mixing shaft 98, and allows the holding developer G to pass along the first path 44 and the second path 46. When the amount of the developer G in the mixture path 32C decreases through consumption and thus the amount of the developer G accumulated upstream of the large diameter portion 98A of the mixing shaft 98 decreases, the amount of the developer G held by the rotary roller 50 decreases in the replenishment system 39, and the second path 46 and the replenishment path 40 are rendered open. Thus, the toner TN is fed to the mixture path 32C along the second path 46 and the replenishment path 40.

On the other hand, when the amount of the developer G in the mixture path 32C increases with the replenishment with the toner TN and the amount of the developer G accumulated upstream of the stopper surface 82 increases, the developer G transported by the mixing auger 90 is stopped by the stopper surface 82 of the projecting portion 80 in the replenishment system 39, and concurrently, the amount of the developer G held by the rotary roller 50 increases.

When the developer G transported by the mixing auger 90 is stopped by the stopper surface 82, the developer G is accumulated in the accumulation space 75 included in the second path 46. Furthermore, the developer G held by the rotary roller 50 is transported to the second path 46, and added to the developer G accumulated in the accumulation space 75, so that the amount of the developer G accumulated in the second path 46 increases. Thus, the second path 46 and the replenishment path 40 are clogged with the developer G. Thus, the replenishment of the toner TN to the mixture path 32C through the second path 46 and the replenishment path 40 is stopped. Specifically, the present exemplary embodiment serves its shutter function of stopping replenishment of the toner TN in response to the second path 46 and the replenishment path 40 being clogged with the developer G.

Operation of Exemplary Embodiment

In the present exemplary embodiment, as illustrated in FIG. 4, the accumulation space 75 is provided in an area including the second path 46 and extending from the second path 46 outward (rightward) in the radial direction of the rotary roller 50. In other words, the accumulation space 75 includes the second path 46 and the area in which the toner TN moving along the second path 46 does not pass.

Figure 10:
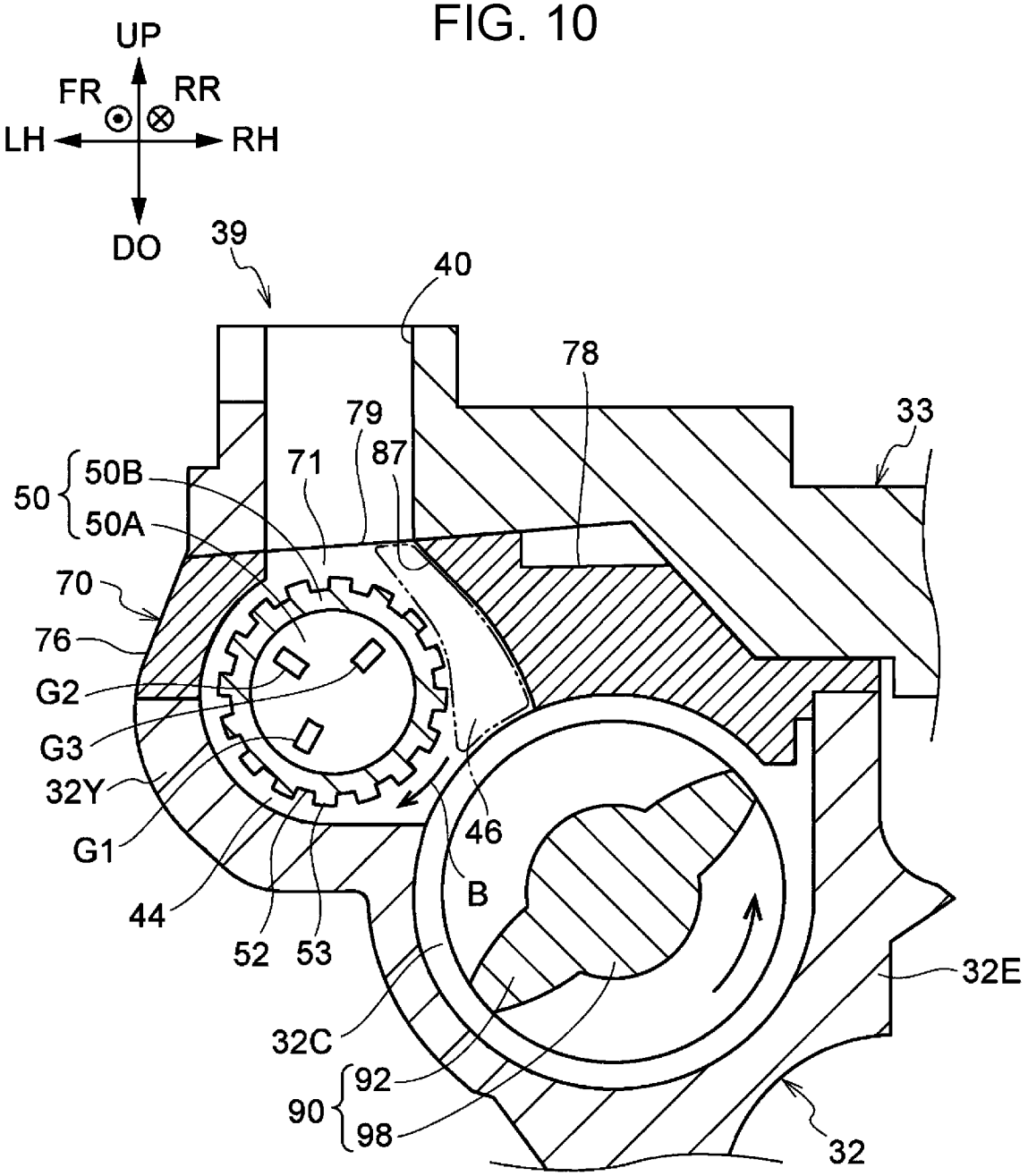
FIG. 10 is a cross-sectional view of a developing device according to a comparative example (first structure), viewed from the front.

Compared to a structure that accumulates the developer G with only the second path 46 without the accumulation space 75 (first structure in FIG. 10), the amount of the developer G that accumulates in the accumulation space 75 (hereinafter referred to as an accumulated developer) increases. Thus, compared to the first structure, the accumulated developer is less likely to collapse, and the developer G transported by the rotary roller 50 to the second path 46 is supported by the accumulated developer. Then, the developer G transported by the rotary roller 50 to the second path 46 is accumulated in the second path 46 on the accumulated developer, serving as a base. Thus, compared to the first structure, this structure is more likely to allow the second path 46 and the replenishment path 40 to be clogged with the developer G, and improves the function (that is, shutter function) of stopping feeding of toner from the replenishment path 40 to the mixture path 32C.

In the exemplary embodiment, the accumulation space 75 allows the developer G shifted upward from the mixture path 32C to be accumulated therein by stopping the developer G with the stopper surface 82.

Thus, compared to the structure (second structure) that does not include the projecting portion 80 and that accumulates the developer G without stopping the developer G with the stopper surface 82, the developer G is prevented from moving downstream in the transport direction, and remains accumulated. Thus, compared to the second structure, this structure improves the function of stopping feeding of toner from the replenishment path 40 to the mixture path 32C.

In the present exemplary embodiment, the stopper surface 82 is disposed upstream of the downstream end of the rotary roller 50 in the transport direction. Thus, compared to a structure (third structure) in which the stopper surface 82 is disposed downstream of the downstream end of the rotary roller 50 in the transport direction, the developer G is more likely to accumulate at a portion holdable by the rotary roller 50. Thus, compared to the third structure, this structure improves the function of stopping feeding of toner from the replenishment path 40 to the mixture path 32C.

In the present exemplary embodiment, the stopper surface 82 is flush with the downstream end of the replenishment path 40 in the transport direction. Thus, compared to the structure (fourth structure) in which the stopper surface 82 is disposed downstream of the downstream end of the replenishment path 40 in the transport direction, the developer G is more likely to accumulate at the position of the replenishment path 40. Thus, compared to the fourth structure, this structure improves the function of stopping feeding of toner from the replenishment path 40 to the mixture path 32C.

In the present exemplary embodiment, the stopper surface 82 is formed at the upstream end of the projecting portion 80 in the transport direction. Thus, compared to the structure in which the stopper surface 82 is formed at a member different from the projecting portion 80, this structure reduces the number of components.

In the present exemplary embodiment, the projecting portion 80 has the restriction surface 89, which restricts upward shift of the developer G accumulated in the accumulation space 75. Compared to the structure (fifth structure) that allows upward shift of the developer G accumulated in the accumulation space 75, this structure prevents the developer G from moving upward, and keeps the developer G in the accumulated state. Thus, compared to the fifth structure, this structure improves the function of stopping feeding of toner from the replenishment path 40 to the mixture path 32C.

In the present exemplary embodiment, the accumulation space 75 includes the area on the side of a vertically upper position of the rotation center of the mixing auger 90, the side being opposite to the side closer to the second path 46 (on the right side of the vertically upper position). Thus, compared to the structure (sixth structure) in which the accumulation space 75 is disposed only in the area on the side of the vertically upper position of the rotation center of the mixing auger 90 closer to the second path 46 (on the left side of the vertically upper position), this structure allows the developer G shifted upward from the mixing auger 90 to accumulate over a wider area. Thus, compared to the sixth structure, the accumulated developer G is less likely to collapse, and the second path 46 and the replenishment path 40 are more likely to be clogged. Thus, compared to the sixth structure, this structure improves the function of stopping feeding of toner from the replenishment path 40 to the mixture path 32C.

In the present exemplary embodiment, the accumulation space 75 extends from the second path 46 upstream in the rotation direction of the mixing shaft 98. Here, the mixing auger 90 transports the developer G with, for example, the second blade 92 and the third blade 93 with rotation of the mixing shaft 98. Thus, the developer G is more likely to move downstream in the rotation direction by being pushed by, for example, the second blade 92 and the third blade 93. Thus, the developer G that shifts upward from the mixture path 32C is more likely to move to the second path 46 in the accumulation space 75 (downstream or leftward in the rotation direction of the mixing shaft 98) compared to the structure (seventh structure) in which the accumulation space 75 extends from the second path 46 only downstream in the rotation direction of the mixing shaft 98.

Thus, compared to the seventh structure, this structure accumulates the developer G in the second path 46 of the accumulation space 75, and improves the function of stopping feeding of toner from the replenishment path 40 to the mixture path 32C.

In the present exemplary embodiment, as illustrated in FIG. 5, the supporter 70 that supports the rotary roller 50 and includes the second path 46 and the accumulation space 75 is separate from the housing 32 including the mixture path 32C therein. Thus, when the supporter 70 is removed from the housing 32, the rotary roller 50, the second path 46, and the accumulation space 75 are integrally removed from the housing 32. Thus, the rotary roller 50, the second path 46, and the accumulation space 75 are allowed to be subjected to adjustment, replacement, and maintenance while being detached from the housing 32.

The present exemplary embodiment thus improves the function of stopping feeding of toner from the replenishment path 40 to the mixture path 32C, and thus prevents a variation of the toner density in the developer G. Specifically, the exemplary embodiment prevents an increase in the toner density of the developer G transported along the mixture path 32C. With the increase in the toner density of the developer G being prevented, the developing device 30 reduces development errors, and image quality degradation of the toner image formed on the sheet P is reduced.

Modification Example

In the present exemplary embodiment, the accumulation space 75 allows the developer G shifted upward from the mixture path 32C to accumulate therein by stopping the developer G with the stopper surface 82. This is, however, not the only possible structure. For example, the developer G may be accumulated only with the large diameter portion 98A.

In the present exemplary embodiment, the stopper surface 82 is disposed downstream of the upstream end of the rotary roller 50 in the transport direction, and upstream of the downstream end of the rotary roller 50 in the transport direction. This is, however, not the only possible structure. For example, the stopper surface 82 may be disposed upstream of the upstream end of the rotary roller 50 in the transport direction, or the stopper surface 82 may be disposed downstream of the downstream end of the rotary roller 50 in the transport direction.

In the present exemplary embodiment, the stopper surface 82 is flush with the downstream end of the replenishment path 40 in the transport direction. This is, however, not the only possible structure. For example, the stopper surface 82 may be disposed downstream of the downstream end of the replenishment path 40 in the transport direction.

In the present exemplary embodiment, the stopper surface 82 is disposed at the upstream end of the projecting portion 80 in the transport direction. This is, however, not the only possible structure. For example, the stopper surface 82 may be disposed at a member different from the projecting portion 80.

In the present exemplary embodiment, the projecting portion 80 has the restriction surface 89 that restricts upward shift of the developer G accumulated in the accumulation space 75. This is, however, not the only possible structure. For example, the developer G may be only stopped by the stopper surface 82.

In the present exemplary embodiment, the accumulation space 75 includes an area on the side of the vertically upper portion of the rotation center of the mixing auger 90, the side being opposite to the side closer to the second path 46 (on the right side of the vertically upper portion of the rotation center). This is, however, not the only possible structure. For example, the accumulation space 75 may be disposed in only the area on the side of the vertically upper portion of the rotation center of the mixing auger 90, closer to the second path 46 (on the left side of the vertically upper portion of the rotation center).

In the present exemplary embodiment, the accumulation space 75 extends from the second path 46 upstream in the rotation direction of the mixing shaft 98. This is, however, not the only possible structure. For example, the developer G shifted upward from the mixture path 32C may be formed in the accumulation space 75 only to the downstream side in the rotation direction of the mixing shaft 98 from the second path 46.

In the present exemplary embodiment, as illustrated in FIG. 5, the supporter 70 that supports the rotary roller 50 and that includes the second path 46 and the accumulation space 75 is separate from the housing 32 including the mixture path 32C therein. This is, however, not the only possible structure. For example, the rotary roller 50 may be supported by the housing 32, and the second path 46 and the accumulation space 75 may be formed in the housing 32.

The present disclosure is not limited to the above-described exemplary embodiments, and may be modified, changed, or improved in various manners within the scope not departing from the gist of the disclosure. For example, any of the above-described modification examples may be appropriately combined with another.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A replenishment system, comprising:

a rotator disposed above a transport path along which a developer is transported and below a replenishment path for toner, the rotator rotating about an axis extending in a transport direction of the transport path while holding the developer;

a path provided downstream of the replenishment path in a rotation direction of the rotator, along a part of an outer circumference of the rotator, the path allowing the toner from the replenishment path to move therealong in the rotation direction to the transport path;

an accumulator provided in an area including the path and extending from the path outward in a radial direction of the rotator, the accumulator accumulating the developer shifted upward from the transport path; and a projecting portion that projects from an upper portion of the transport path into the transport path, the projecting portion having a lower surface forming a path surface of the transport path, wherein the accumulator accumulates the developer stopped by a stopper surface facing upstream in the transport direction and the stopper surface is disposed at an upstream end of the projecting portion.

2. The replenishment system according to claim 1, wherein the stopper surface is disposed upstream of a downstream end of the rotator in the transport direction.

3. The replenishment system according to claim 2, wherein the stopper surface is flush with a downstream end of the replenishment path in the transport direction.

4. The replenishment system according to claim 1, further comprising:

a restriction surface disposed above the lower surface of the projecting portion, the restriction surface restricting upward shift of the developer accumulated in the accumulator.

5. The replenishment system according to claim 1, wherein a transporting member that rotates about an axis extending in the transport direction to transport the developer is disposed in the transport path, and wherein the accumulator includes an area on a side of a vertically upper portion of a rotation center of the transporting member, the side being opposite to a side on which the path is provided.

6. The replenishment system according to claim 5, wherein the transporting member includes a shaft portion extending in the transport direction, and a blade helically extending on an outer circumferential surface of the shaft portion and transporting the developer with rotation of the shaft portion, and wherein the accumulator extends upstream from the path in a rotation direction of the shaft portion.

7. The replenishment system according to claim 1, further comprising:

a supporter separate from a housing including the transport path therein, the supporter rotatably supporting the rotator, and the supporter including the path and the accumulator.

8. A developing device, comprising:

a transport path; and the replenishment system according to claim 1 that replenishes the transport path with toner.

9. An image forming apparatus, comprising:

a latent image carrier that holds a latent image;

the developing device according to claim 8 that develops the latent image into an image; and a transfer portion that transfers the image developed by the developing device to a recording medium.

10. A replenishment system, comprising:

a rotator disposed above a transport path along which a developer is transported and below a replenishment path for toner, the rotator rotating about an axis extending in a transport direction of the transport path while holding the developer;

a path provided downstream of the replenishment path in a rotation direction of the rotator, along a part of an outer circumference of the rotator, the path allowing the toner from the replenishment path to move therealong in the rotation direction to the transport path; and an accumulator including the path and an area in which the toner that moves along the path does not pass, the accumulator accumulating the developer shifted upward from the transport path; and a projecting portion that projects from an upper portion of the transport path into the transport path, the projecting portion having a lower surface forming a path surface of the transport path, wherein the accumulator accumulates the developer stopped by a stopper surface facing upstream in the transport direction and the stopper surface is disposed at an upstream end of the projecting portion.

* * * * *